US011521585B2

(12) United States Patent
Mahdavi et al.

(10) Patent No.: US 11,521,585 B2
(45) Date of Patent: Dec. 6, 2022

(54) METHOD OF COMBINING AUDIO SIGNALS

(71) Applicant: AI MUSIC LIMITED, Sevenoaks (GB)

(72) Inventors: Siavash Haroun Mahdavi, Sevenoaks (GB); David Michael Ronan, Sevenoaks (GB); Andrew Shayan Khavand, Sevenoaks (GB)

(73) Assignee: AI Music Limited, Sevenoaks (GB)

( * ) Notice: Subject to any disclaimer, the term of this patent is extended or adjusted under 35 U.S.C. 154(b) by 123 days.

(21) Appl. No.: 16/975,644

(22) PCT Filed: Feb. 26, 2019

(86) PCT No.: PCT/GB2019/050524
§ 371 (c)(1),
(2) Date: Aug. 25, 2020

(87) PCT Pub. No.: WO2019/162703
PCT Pub. Date: Aug. 29, 2019

(65) Prior Publication Data

US 2020/0410968 A1 Dec. 31, 2020

(30) Foreign Application Priority Data

Feb. 26, 2018 (GB) ..... 1803072

(51) Int. Cl.
*G10H 1/00* (2006.01)
*G10L 13/00* (2006.01)

(52) U.S. Cl.
CPC ..... *G10H 1/0025* (2013.01); *G10L 13/00* (2013.01); *G10H 2210/031* (2013.01);
(Continued)

(58) Field of Classification Search
CPC ..... G10H 1/0025; G10H 2210/031; G10H 2210/036; G10H 2210/056;
(Continued)

(56) References Cited

U.S. PATENT DOCUMENTS 6,167,192 A * 12/2000 Heo ..... G11B 20/10527 386/244
6,192,340 B1 * 2/2001 Abecassis ..... H04M 1/72403 455/418
(Continued)

FOREIGN PATENT DOCUMENTS

CN 105659314 B * 9/2019 ..... G06F 16/60
EP 1 959 429 A1 8/2008
(Continued)

OTHER PUBLICATIONS

British Office Action dated Nov. 1, 2021, from application No. GB1803072.6.
(Continued)

*Primary Examiner* — Christina M Schreiber
(74) *Attorney, Agent, or Firm* — Blank Rome LLP

(57) ABSTRACT

A method for automatically generating an audio signal, the method comprising receiving a source audio signal analyzing the source audio signal to identify a musical parameter characteristic thereof obtaining a supplemental audio signal based on the identified musical parameter characteristic and combining the source audio signal and the supplemental audio signal to form an extended audio signal.

20 Claims, 13 Drawing Sheets

(52) U.S. Cl.
CPC . *G10H 2210/036* (2013.01); *G10H 2210/056* (2013.01); *G10H 2210/076* (2013.01); *G10H 2210/081* (2013.01); *G10H 2210/125* (2013.01); *G10H 2210/341* (2013.01); *G10H 2210/576* (2013.01); *G10H 2240/131* (2013.01)

(58) Field of Classification Search
CPC ..... G10H 2210/076; G10H 2210/081; G10H 2210/125; G10H 2210/341; G10H 2210/576; G10H 2240/131; G10L 13/00
USPC ..... 84/609
See application file for complete search history.

(56) References Cited

U.S. PATENT DOCUMENTS

| | | | | |
|---|---|---|---|---|
| 8,560,391 | B1 * | 10/2013 | Shaw | G06Q 30/0251 705/14.69 |
| 8,710,343 | B2 * | 4/2014 | Kellett | G10H 1/38 84/610 |
| 8,745,259 | B2 * | 6/2014 | Deinhard | H04N 21/6125 709/217 |
| 9,070,351 | B2 * | 6/2015 | Kellett | G10H 1/08 |
| 9,230,528 | B2 * | 1/2016 | Kellett | G10H 1/00 |
| 9,697,813 | B2 * | 7/2017 | Lyske | G10H 1/40 |
| 9,812,152 | B2 * | 11/2017 | Christian | G10L 25/27 |
| 11,341,986 | B2 * | 5/2022 | Faizakof | G10L 15/063 |
| 2003/0183064 | A1 * | 10/2003 | Eugene | G10H 1/0033 84/609 |
| 2006/0230909 | A1 * | 10/2006 | Song | G10H 3/125 84/609 |
| 2008/0190268 | A1 * | 8/2008 | McNally | G11B 27/031 84/645 |
| 2009/0217805 | A1 * | 9/2009 | Lee | G10H 1/0025 84/613 |
| 2009/0314155 | A1 * | 12/2009 | Qian | G10H 1/06 84/622 |
| 2011/0100197 | A1 * | 5/2011 | Rechsteiner | G10H 7/008 84/609 |
| 2012/0312145 | A1 * | 12/2012 | Kellett | G10H 1/38 84/613 |
| 2014/0123006 | A1 * | 5/2014 | Chen | H04N 21/26258 715/716 |
| 2016/0078879 | A1 * | 3/2016 | Lu | G10L 25/81 381/56 |
| 2016/0189232 | A1 * | 6/2016 | Meyer | G06Q 30/0267 705/14.58 |
| 2020/0410968 | A1 * | 12/2020 | Mahdavi | G10L 13/00 |
| 2021/0104220 | A1 * | 4/2021 | Mennicken | G06F 3/165 |
| 2021/0326707 | A1 * | 10/2021 | Lyske | G06F 40/30 |

FOREIGN PATENT DOCUMENTS

| | | | | |
|---|---|---|---|---|
| EP | 3 035 333 | A1 | 6/2016 | |
| EP | 3035333 | A1 * | 6/2016 | G06F 17/30746 |
| GB | 2 550 090 | A | 11/2017 | |
| GB | 2 557 970 | A | 7/2018 | |
| WO | WO-2008/052009 | | 5/2008 | |
| WO | WO-2008052009 | A2 * | 5/2008 | G10H 1/0025 |
| WO | WO-2014/022554 | | 2/2014 | |
| WO | WO-2014/047322 | | 3/2014 | |
| WO | WO-2016/207625 | | 12/2016 | |
| WO | WO-2017/089393 | | 6/2017 | |

OTHER PUBLICATIONS

Blaauw, Merlijn, and Jordi Bonada., "A Neural Parametric Singing Synthesizer Modeling Timbre and Expression from Natural Songs." Applied Sciences 7.12 (2017): 1313.
International Search Report and Written Opinion dated Jul. 6, 2019, from related application No. PCT/GB2019/050524.
Jamdar, Adit et al., "Emotion analysis of songs based on lyrical and audio features." arXiv preprint arXiv:1506.05012 (2015).
Kim, Youngmoo E., et al., "Music emotion recognition: A state of the art review." Proc. ISMIR. 2010.
Mauch, Matthias, Katy C. Noland, and Simon Dixon., "Using Musical Structure to Enhance Automatic Chord Transcription." ISMIR. 2009.
McVicar, Matt, Daniel PW Ellis, and Masataka Goto., "Leveraging repetition for improved automatic lyric transcription in popular music." Acoustics, Speech and Signal Processing (ICASSP), 2014 IEEE International Conference on. IEEE, 2014.
Moffat, David, David Ronan, and Joshua D. Reiss. "An evaluation of audio feature extraction toolboxes." International Conference on Digital Audio Effects (DAFx), 2016.
R. Itu-r, "Itu-r bs. 1770-2, algorithms to measure audio programme loudness and true-peak audio level," International Telecommunications Union, Geneva, 2011.
Salamon, Justin, et al., "Melody extraction from polyphonic music signals: Approaches, applications, and challenges." IEEE Signal Processing Magazine 31.2, (2014): 118-134.
Scholz, Florian, Igor Vatolkin, and Gunter Rudolph., "Singing Voice Detection across Different Music Genres." Audio Engineering Society Conference: 2017 AES International Conference on Semantic Audio. Audio Engineering Society, 2017.
Search Report under Section 17 dated Aug. 27, 2018, for GB Application No. 1803072.6.
Shen, Jonathan, et al., "Natural TTS Synthesis by Conditioning WaveNet on Mel Spectrogram Predictions." arXiv preprint arXiv:1712.05884 (2017).
Vogl, Richard, et al., "Drum transcription via joint beat and drum modeling using convolutional recurrent neural networks." Proceedings of the 18th International Society for Music Information Retrieval Conference (ISMIR), Suzhou, CN. 2018.
Wang Zhe, Jingbo Xia, and Bin Luo. "The Analysis and Comparison of Vital Acoustic Features in Content-Based Classification of Music Genre." Information Technology and Applications (ITA), 2013 International Conference on. IEEE, 2013.
Yela Delia Fano, et al., "On the Importance of Temporal Context in Proximity Kernels: A Vocal Separation Case Study.",Audio Engineering Society Conference: 2017 AES International Conference on Semantic Audio.

* cited by examiner

METHOD OF COMBINING AUDIO SIGNALS

CROSS-REFERENCE TO RELATED APPLICATIONS

The present application is a U.S. national stage application under 35 U.S.C. § 371 claiming the benefit of International Patent Application No. PCT/GB2019/050524, filed 26 Feb. 2019, which is based on and claims foreign priority to GB patent application number 1803072.6, filed 26 Feb. 2018, which document is hereby incorporated by reference.

FIELD OF THE INVENTION

The present invention relates to processing audio signals, in particular to automatically combining two successive audio signals or streams via a transitional audio signal or stream.

BACKGROUND

In a traditional music-based radio station, or when a DJ comperes a set at a club or event, messages of various types are usually interspersed between tracks. The messages may, for example, include: identification (e.g. artist and track names) or comment on the previous or next track; station identifiers or jingles; news; weather forecasts; advertisements; or just general chat. Such messages increase listeners' engagement with the radio station or DJ and provide useful information.

More recently, music streaming services offer large numbers of algorithmically generated "stations" or playlists of tracks selected according to some criteria, such as era, genre or artist. Listeners can readily select a station that suits their taste and/or mood from the wide variety available. However, such algorithmic stations and playlists do not include messages between tracks but rather play one track to the end and immediately start the next. Algorithmic stations and playlists can therefore lack the engagement of a human-curated radio station.

U.S. Pat. No. 6,192,340B1 discloses a method in which informational items obtained from an information provider are interleaved into a sequence of musical items. The informational items, e.g. stock quotes, are received as text and converted to audio by a voice synthesizer. Parameters of the audio informational items, such as the voice to be used for the synthesis, speed and volume, are set by user preference. Although the method of U.S. Pat. No. 6,192,340B1 has great flexibility to cater to a user's preferences for music and information sources, the resulting output can be artificial and disjointed.

SUMMARY

It is an aim of the invention to provide an improved method of automatically combining audio signals and informational messages in a way that is more appealing to a listener, in particular by improving the transitions between musical items and informational items.

According to an embodiment of the invention, there is provided a method for automatically generating an audio signal, the method comprising: receiving a source audio signal; analyzing the source audio signal to identify a musical characteristic thereof; obtaining a supplemental audio signal based on the identified musical characteristic; and combining the source audio signal and the supplemental audio signal to form an extended audio signal.

Therefore, embodiments of the invention can provide an audio processing system for a computer based audio streaming service that automatically generates a transitional audio signal based on factors such as the general context of the listener as well as the musical mood, musical intensity, musical genre, musical key, musical melody, musical tempo, musical metadata and/or sentiment of the lyrics of an associated audio signal. Matching can be based on either or both of the preceding and succeeding audio signals.

BRIEF DESCRIPTION OF THE DRAWINGS

The present invention will be described further below with reference to exemplary embodiments and the accompanying drawings, in which.

In the various figures, like parts are identified by like references.

DETAILED DESCRIPTION

Figure 1:
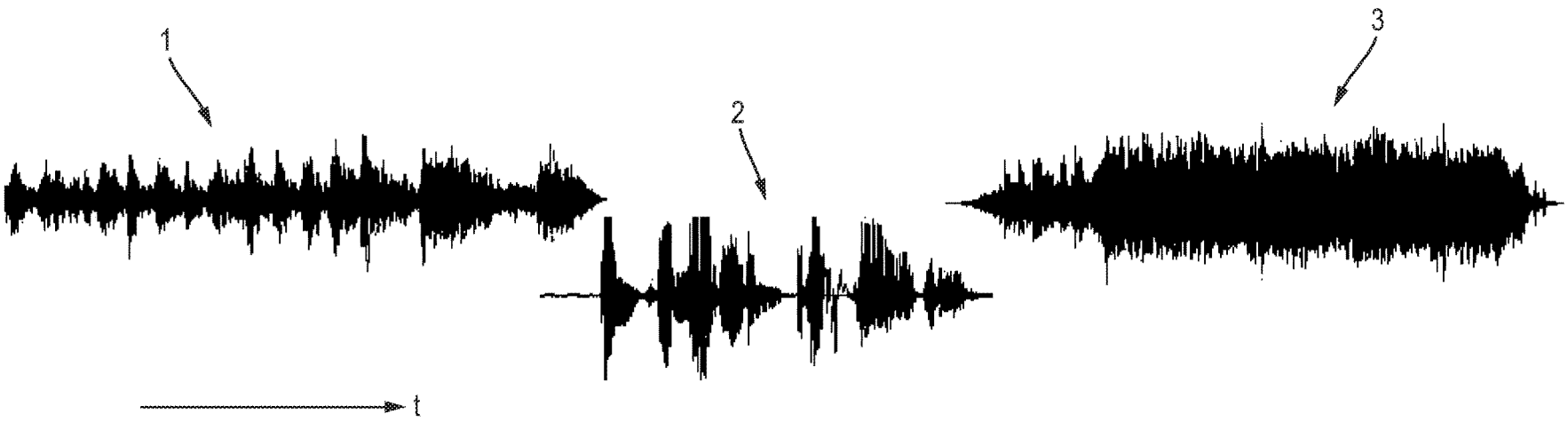
FIG. 1 depicts a time sequence relationship between audio signals that precede and succeed the automatically generated transitional audio signal.

The basic function of an embodiment of the invention is to automatically generate an extended audio signal by combining a source audio signal with a supplemental audio signal, for example to provide a customized transition from one source audio signal to another. This is illustrated in FIG. 1, where the source audio signals 1, 3 being transitioned from and transitioned into are two different songs, but they could be any type of audible media. The source audio signals may each be any piece of music, or part of a piece of music, and may be referred to as a track. The source audio signals are also referred to below as the preceding audio signal 1 and the succeeding audio signal 3. A customized transitional audio signal 2 as an example of a supplemental audio signal is generated as described below. Embodiments of the invention can be used in radio broadcasts, podcasts, personalized music streaming services or automatic DJ software. In the present disclosure, the term "audio signal" is intended to refer to a series of data that can be decoded and/or decompressed then used to generate an analog signal that can be converted by a transducer, such as a loudspeaker or headphone, to sound audible by a human listener. When stored in electronic form, such an audio signal may be accompanied by metadata, however such metadata is not required for operation of the present invention.

The transitional audio signal 2 may contain one or more of: music; a jingle; a personalized message; a public service announcement; a news report; a weather report; a station indent; information about the preceding/succeeding audio signal (such as track or artist name); a notification generated by the operating system or an app of a device which is playing the combined audio signal. It is not essential that the transitional audio signal 2 includes any vocal element.

In an embodiment of the invention, the transitional audio signal 2 is generated based on high and low level audio features extracted from either or both of the preceding and succeeding audio signals and optionally the context of the listener. The context of the listener can include factors such as: user location; user current activity, current weather and/or the user's current emotional state; an entry in an electronic calendar. Contextual information can be acquired from the computer device that the user may be operating. The generated transitional audio signal can be prepared in advance or generated on the fly, allowing time for audio feature extraction, audio analysis, server computation etc.

The purpose of the transitional audio signal is to allow a smooth and seamless transition from one audio signal into another, where the preceding and succeeding audio signals can simply fade in or fade out from the transitional audio signal. Desirably, the content of the transitional audio signal is generated so as to be as non-invasive as possible, but it is also possible to provide a transitional audio signal that contrasts with the preceding and succeeding signals. In an embodiment, the transitional audio signal contains a musical element which matches a musical characteristic—such as at least one of: mood, intensity, genre, key, melody, tempo, metadata and/or sentiment of the lyrics—of the preceding audio signal and/or the succeeding audio signal. How this is achieved is described further below.

In an embodiment, the transitional audio signal contains a vocal element, e.g. a spoken voice or sung vocal, with the intention of providing a specific message which also matches at least one of the musical mood, musical intensity, musical genre, musical key, musical melody, musical tempo, musical metadata and/or sentiment of the lyrics of the preceding audio signal and/or the succeeding audio signal. If the transitional audio signal is to contain a vocal element such as a sung vocal or spoken voice, then this will determine the length of the transitional audio section. The transitional audio signal is desirably longer than the vocal element by a predetermined time or proportion. The generation of the vocal element is described further below.

It is to be noted that a match of a musical characteristic does not have to be exact and in particular if the preceding and succeeding audio signals differ in a musical characteristic, the transitional audio signal can have a musical characteristic that is between the musical characteristic of the preceding and succeeding audio signals so as to smooth the transition.

Various different procedures can be used to generate a musical element for the transitional audio signal. In a first procedure, the preceding audio signal and/or the succeeding audio signal are analyzed to identify at least one musical characteristic, e.g. the musical mood, musical intensity, musical genre, musical key, musical melody, musical tempo, musical metadata and/or sentiment of the lyrics thereof. In an embodiment, analysis of the audio signal does not require reference to any metadata. The identified characteristics are used to select a musical element from a database of prerecorded music. The selection can also be based on a context analysis 105*b* of the listener at the relevant time.

In a second procedure to generate a musical element for the transitional audio signal, a suitable musical section from either the preceding audio signal or the succeeding audio signal is extracted. A procedure for selection of a suitable section of an audio signal is described below. The extracted musical section is looped until the next audio signal is meant to start.

In the third procedure to generate a musical element for the transitional audio signal, first either the preceding audio signal or the succeeding audio signal are analyzed to identify at least one musical characteristic, e.g. musical mood, musical intensity, musical genre, musical key, musical melody, musical tempo, musical metadata and/or sentiment of the lyrics. The identified musical characteristic(s) are then used to generate music using samplers and/or synthesizers to match either the preceding audio signal or the succeeding audio signal.

Figure 2:
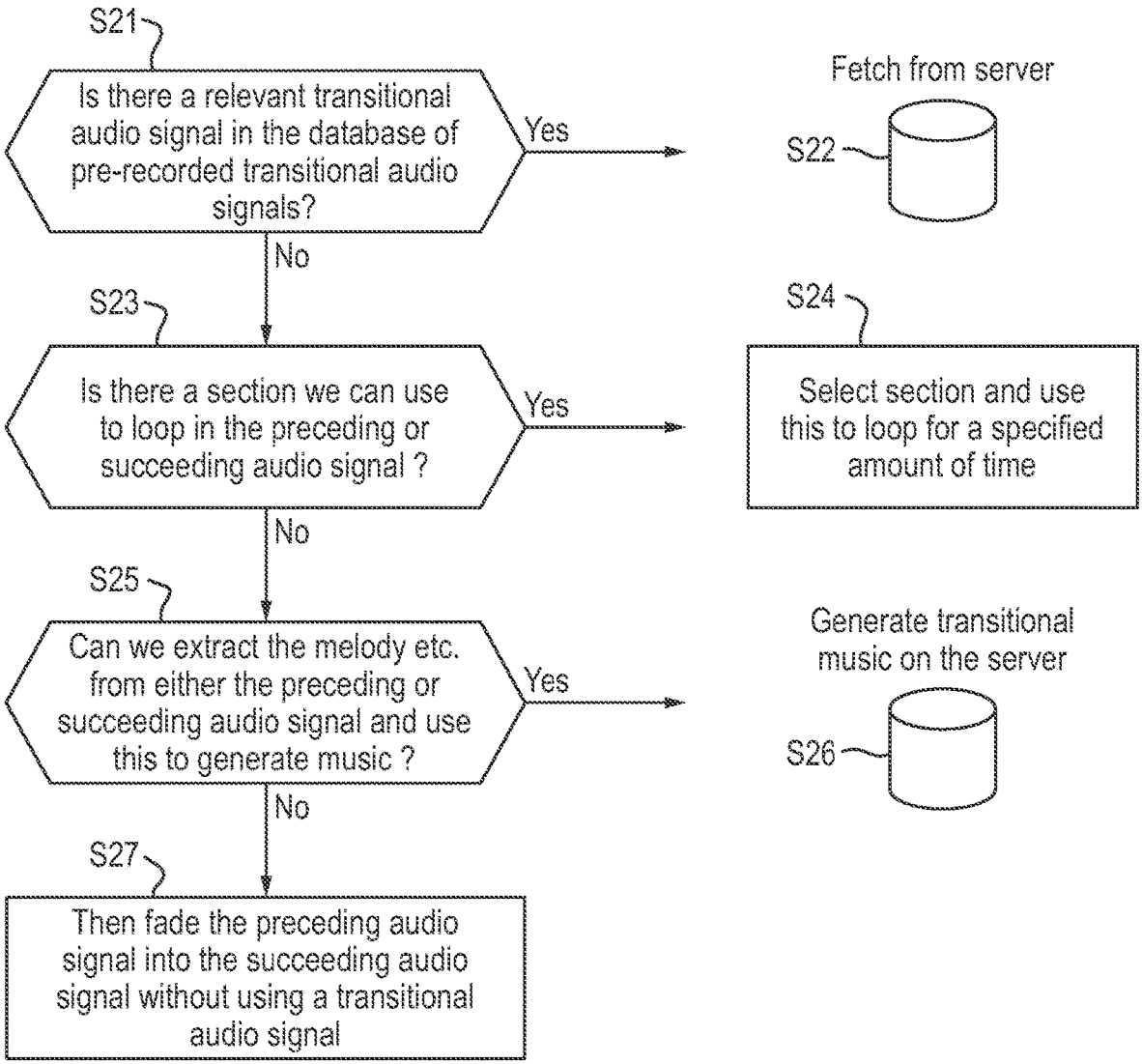
FIG. 2 depicts a decision process for the type of transitional audio signal when music is required.

The procedure used to generate the transitional audio signal can be predetermined, selected by the user of the apparatus or chosen automatically. If the selection of the procedure for generation of the transitional audio signal is automated, this can be done by a process of elimination, as shown in FIG. 2.

The first step is to check S21 if there is a relevant musical transitional audio signal stored in the database S22. If there is not a relevant musical transitional audio signal stored in the database S22, then the second procedure S23 is attempted to find a suitable section of audio to loop in the preceding or succeeding audio signal. If the second procedure S23 is able to find a suitable section of audio at S24, then it may be selected and looped for a specified amount of time. If the second procedure S23 is unable to find a suitable section of audio to loop, then the third procedure S25 is attempted. If the third procedure S25 is able to extract a melody or other relevant audio characteristic from either the preceding or succeeding audio signal at S26, then it may be used to generate transitional music on the server. If the third procedure S25 fails, then, at S27, the preceding audio signal is simply crossfaded into the succeeding audio signal. Other orders to attempt the procedures can be used and may be subject to user preferences.

Figure 3:
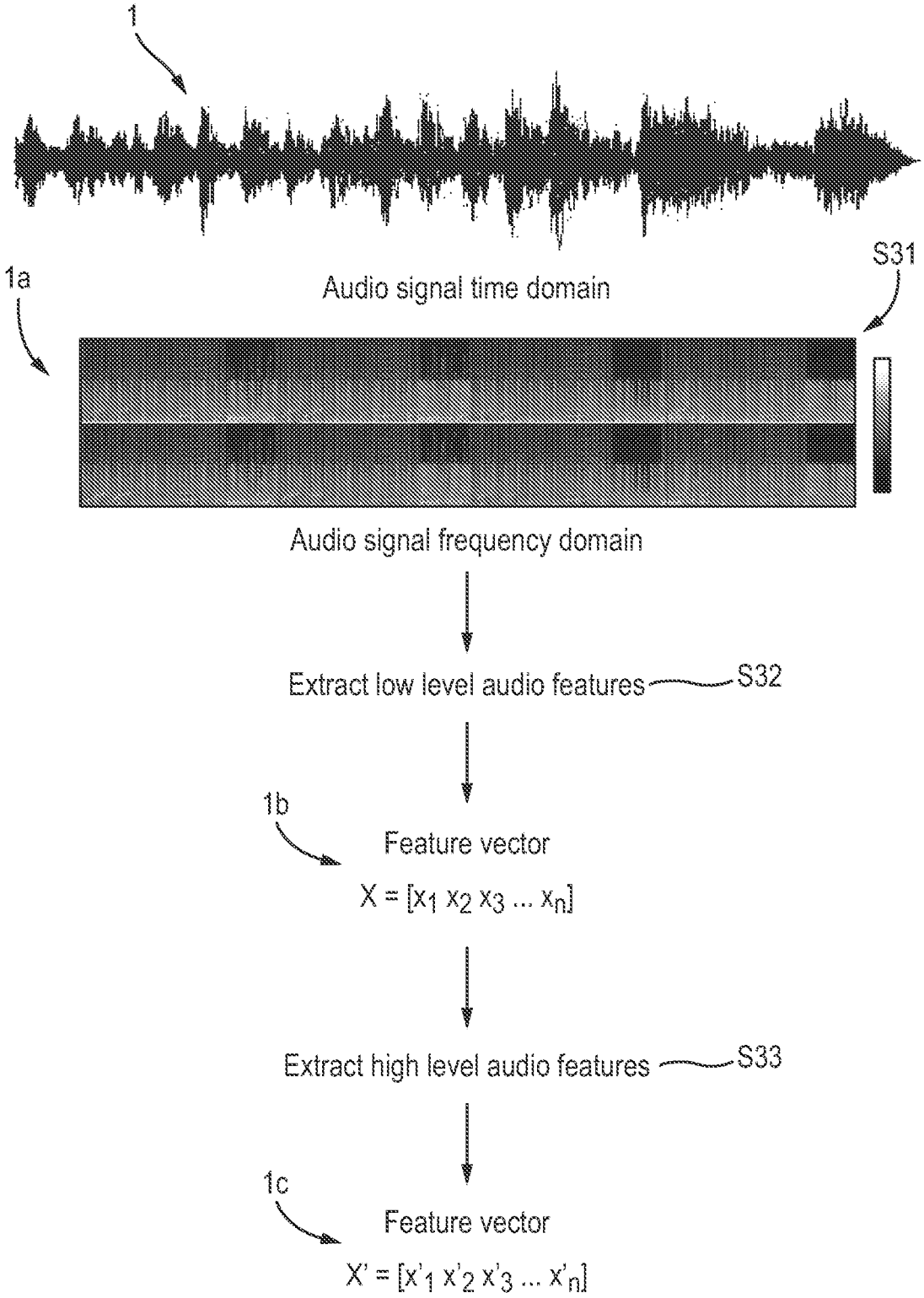
FIG. 3 is a flow diagram of a method of the invention showing low and high level audio feature extraction, where the high level features are derived from the low level features.

In an embodiment of the invention, to extract one or more musical characteristics, such as musical mood, musical intensity, musical genre, musical key, musical melody and/or musical tempo, low and high level audio features are extracted from an audio signal. This is illustrated in FIG. 3. Source audio signal 1 represented in the time domain, is transformed S31 to the time-frequency domain 1*a*. The low level audio features are extracted S32 and expressed in a lower level feature vector 1*b*. Then the high level audio features are derived S33 from the low level audio features and expressed as a high level feature vector 1*c*. The high level audio features such as tempo and key strength can then be described in terms of common acoustic attributes such as dynamics, timbre, harmony, register, rhythm and articulation as described in [Ref. 1]. Values for these attributes can be obtained by reference to measured audio features as follows:

TABLE 1

| Type | Features |
|---|---|
| Dynamics | RMS energy |
| Timbre | MFCCs, spectral shape, spectral contrast |
| Harmony | Roughness, harmonic change, key clarity, majorness |
| Register | Chromagram, chroma centroid and deviation |
| Rhythm | Rhythm strength, regularity, tempo, beat histograms |
| Articulation | Event density, attack slope, attack time |

These common audio features can also be used in combination to describe the genre and mood of a piece of music, where the features can be used to discriminate between pieces music based on instrumentation, rhythmic patterns and pitch distributions [Ref 2].

Furthermore, these audio features can easily be extracted from audio signals using open source feature extraction libraries, such as Essentia, MIR Toolbox or LibXtract [Ref 3]. To determine how close a match two audio signals are, simple calculations such as the Euclidean distance or the cosine distance between the audio feature vectors that represent each audio signal can be used. In an embodiment, any lyrics an audio signal may contain are also analyzed by performing sentiment analysis 105*a*, this helps in determining the mood of a piece of music. Analysis can be based on lyrics as recorded in a database or from speech recognition as described in [Ref. 13]. Sentiment analysis 105*a* can be based on Arousal and Valence features which are obtained from a weighted sum of Arousal and Valence values of individual words in the lyrics. Arousal and Valence values for words are obtained from available dictionaries. More details can be found in [Ref 4].

Figure 4:
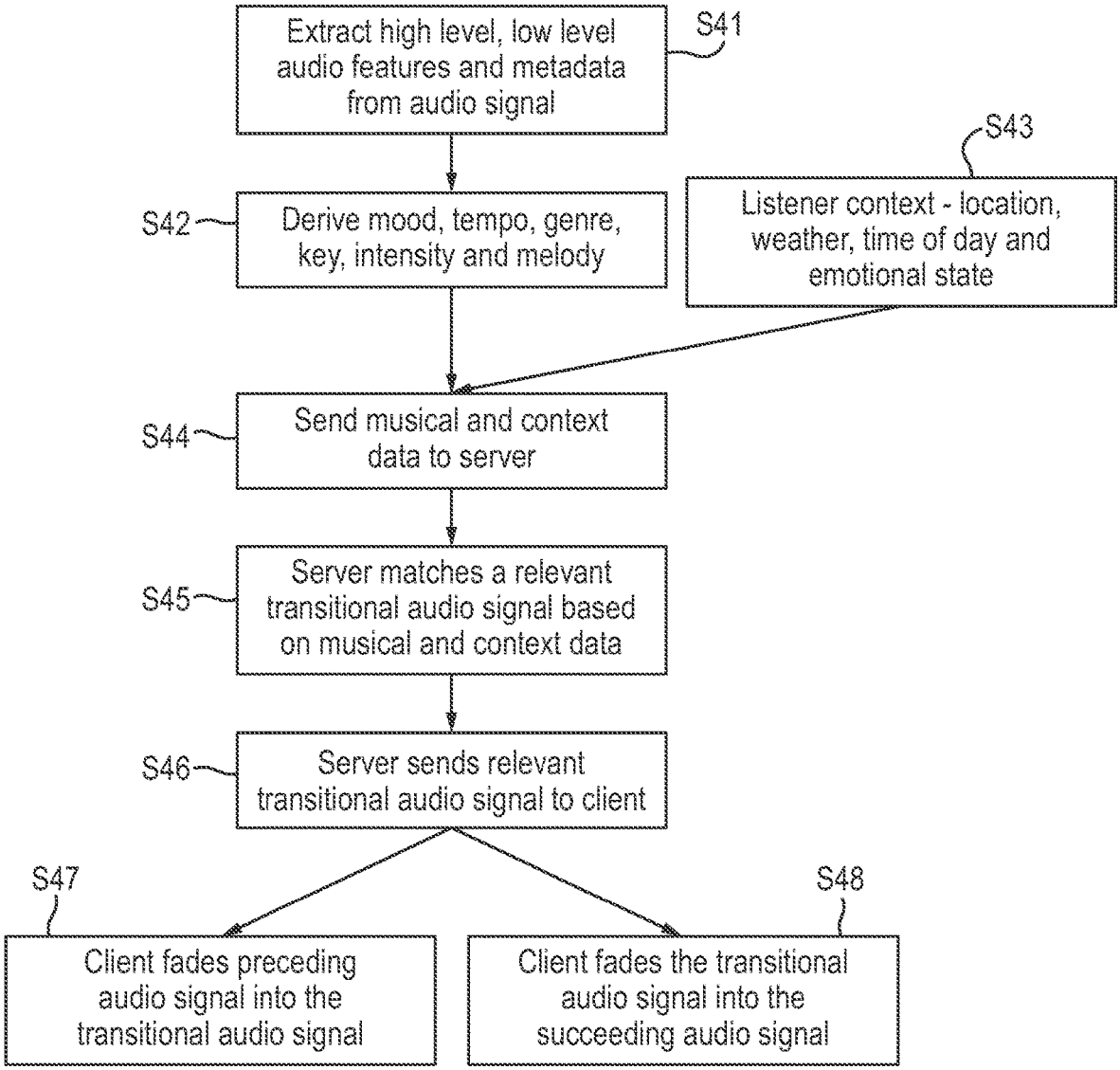
FIG. 4 is a flow diagram of a method of the invention showing how the server matches a transitional audio signal to a preceding or succeeding audio signal.
Figure 5:
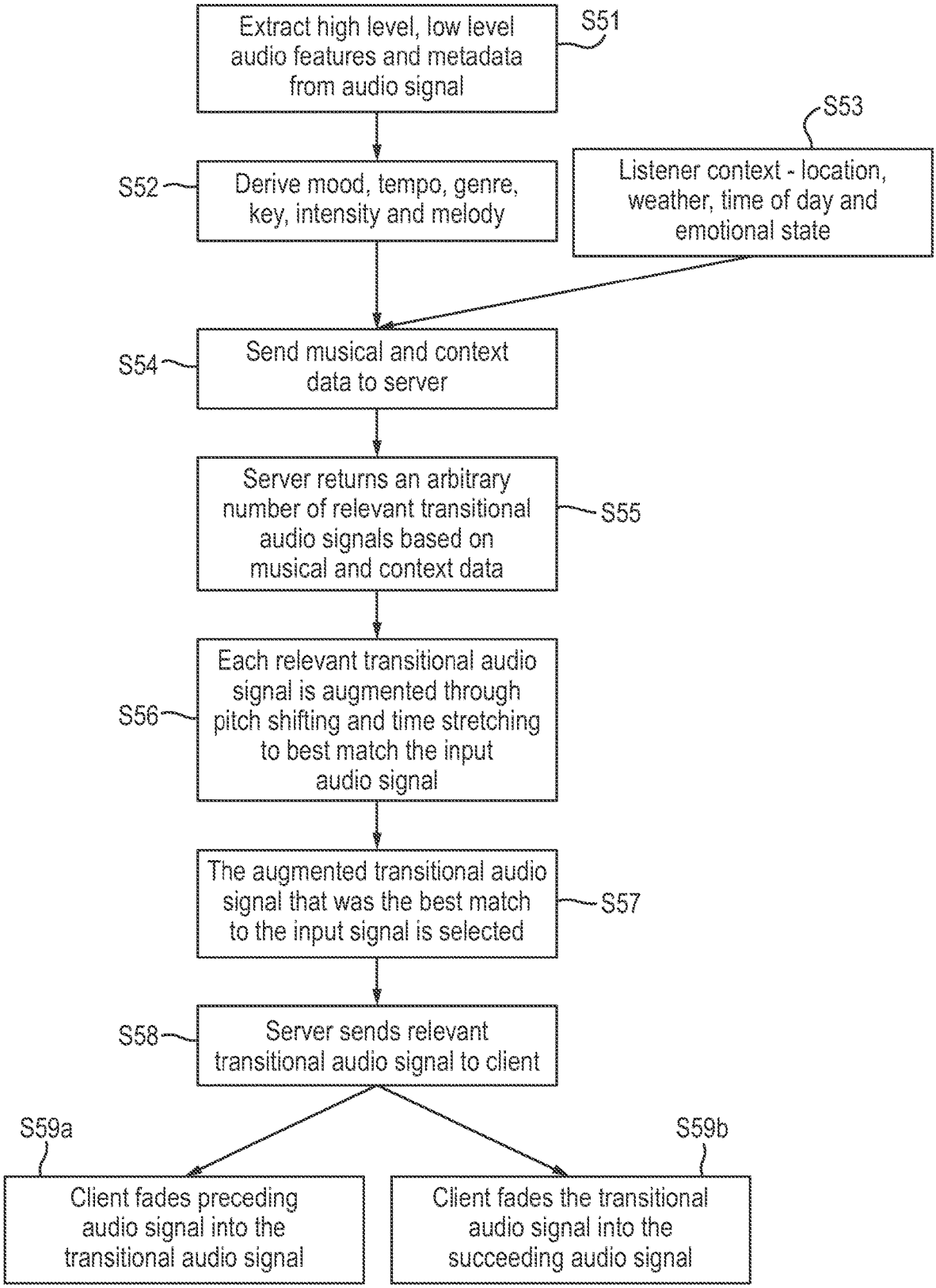
FIG. 5 is a flow diagram of a method of the invention showing how the server matches a transitional audio signal to a preceding or succeeding audio signal using augmentation.

Thus, the overall method of an embodiment of the invention is illustrated in FIG. 4. First the low and high level audio features are extracted from an audio steam S41. This step can be done just in time—i.e. when the signal is being, or is about to be, played—or in advance—e.g. when a database music library or playlist is put together. Next the musical characteristic(s) are derived S42 and listener context information is obtained S43. The musical characteristics and context information are communicated S44 to the server. The server obtains S45 a matching transitional audio signal and sends S46 to the transitional audio signal 2 to a client. The client loads S47 the preceding audio signal 1 into the transitional audio signal 2 and then loads the transitional audio signal 2 into the succeeding audio signal 3. The amount of overlap between the different audio signals can be predetermined, set by user preference, or determined on the basis of the musical characteristics of the preceding and succeeding audio signals.

In a further embodiment, the transitional audio signal matching technique is extended. This is illustrated in FIG. in which steps S51 to S55 are the same as steps S41 to S45 and steps S58 to S59*a* and S59*b* are the same as steps S46 to S48. The common steps are not described further in the interest of brevity. In the previous embodiment, the preceding and/or succeeding audio signal are matched to one particular transitional audio signal in a database. In this further embodiment, the same matching procedure using Euclidean distance or cosine distance is used, but, instead of returning one candidate, a plurality of candidates is selected S55. The number of candidates may be predetermined or a user preference. Each of the selected candidates is then altered S56 using music information retrieval (MIR) techniques such as pitch shifting and time stretching so that they are as close a match as possible in terms of musical mood, musical intensity, musical genre, musical key, musical melody and/or musical tempo to the preceding and/or succeeding audio signal. The altered versions of each candidate are then measured to see how close a match each of them are to the preceding and/or succeeding audio signal. The altered candidate that is the closest match is then selected S57 as the transitional audio signal. Limits can be set on by how much each candidate transitional audio signal can be pitch shifted or time stretched in order to avoid artefacts.

Figure 6:
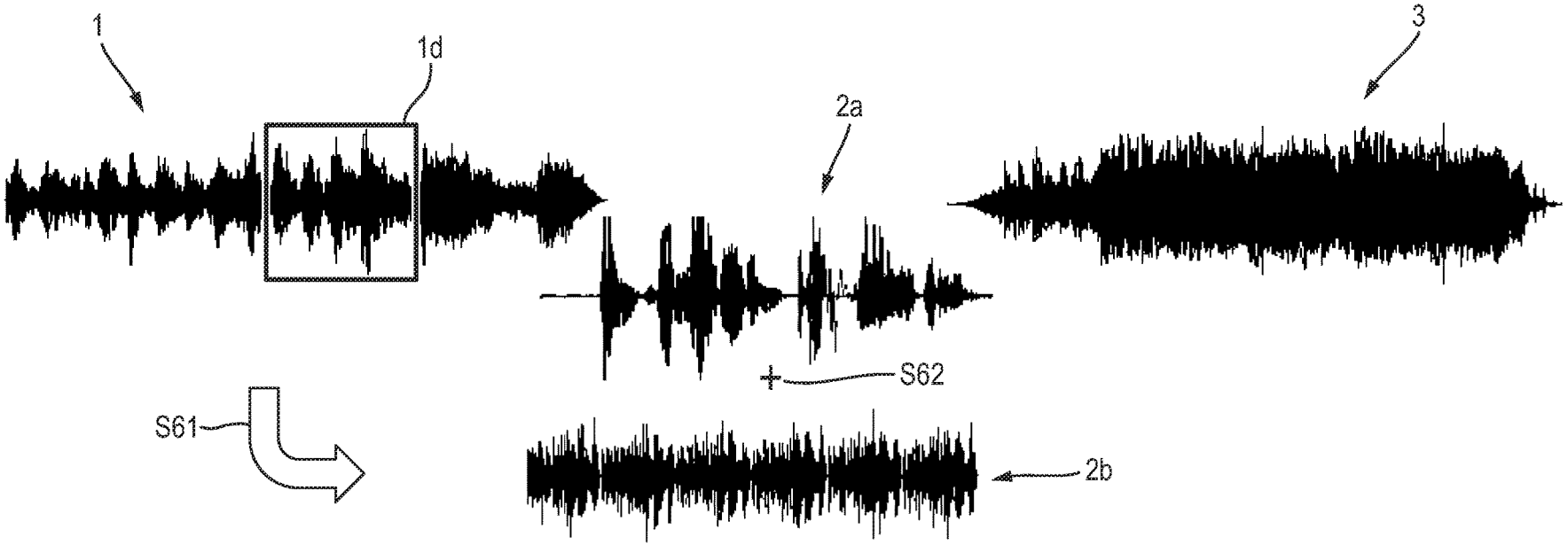
FIG. 6 depicts a method to extract a musical section from a preceding audio signal and use it as background music to a vocalized message in transitional audio signal.

In another embodiment of the invention, illustrated in FIG. 6, a section 1*d* from either the preceding or succeeding audio signal is extracted S6 and used as a loop in a transitional audio signal. Either the preceding or succeeding audio signal is segmented using an automatic segmentation algorithm, for example by finding approximately repeated chroma sequences in a song and a greedy algorithm to decide which of the sequences are indeed segments. Further details can be found in [Ref 5]. Once each segment has been identified, each segment has audio features relevant to singing voice detection extracted from it. These audio features form a feature vector, which is then passed to a pre-trained machine learning classifier such as a Random Forest or Neural Network to decide if the segment contains vocals [Ref. 6]. If a segment does not contain vocals, then the segment is marked as a candidate for the selected loop of the transitional audio signal. If there is no section that contains vocals, then the vocal is removed from a segment, for example by a Kernel Additive Modelling method such as described in [Ref. 7].

If a vocal element is to be used in the transitional audio signal, then the segment that best fits the time length of the message is selected. Alternatively, the segment of audio that is the quietest overall can be selected. The volume of a segment can be measured using RMS or a weighted mean-square measure as described [Ref 8]. If there is to be no vocal element, then the last identified segment of the preceding audio signal or the first identified segment of the succeeding audio signal is to be used. The transitional audio signal is then constructed S62 by combining a vocal element 2*a* with a musical element 2*b* obtained by repeating S61 the extracted section 1*d* a suitable member of times to match the length of the vocal element 2*a*.

Figure 7:
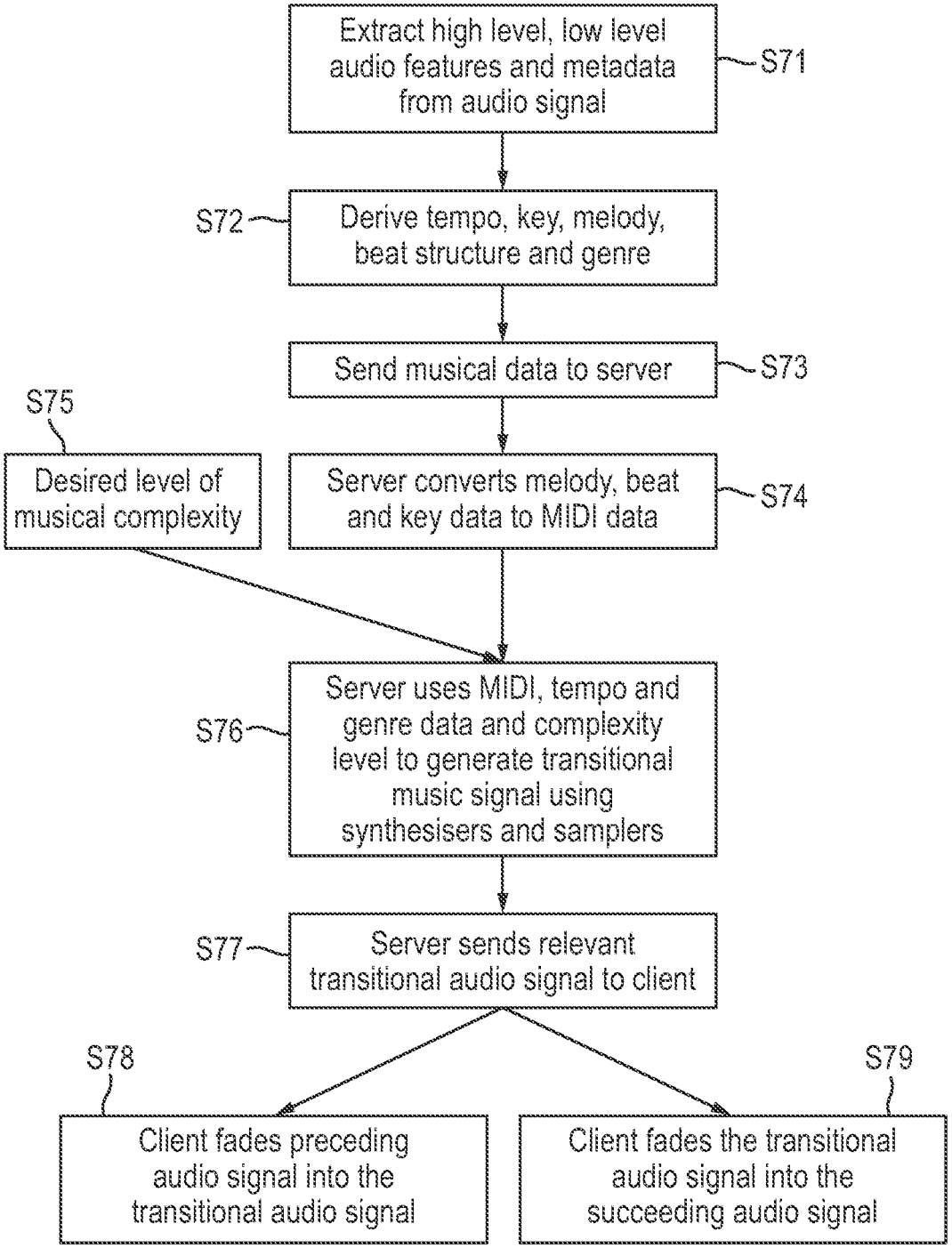
FIG. 7 is a flow diagram of a method of the invention showing how the server generates the music of a relevant transitional audio signal.

An embodiment of the invention in which the music for the transitional audio signal is generated is shown in FIG. 7. In this method, steps S71 to S73 and S77 to S79 are the same as the corresponding steps in the above described embodiments and are therefore not described further in the interests of brevity. In this embodiment, either or both of the preceding or succeeding audio signals is segmented using an automatic segmentation algorithm in the same way as described above. Once each segment has been identified, each segment is passed through a melody, chord and beat transcription algorithm S74. Numerous suitable algorithms are known as described in [Ref. 5, 9, 10], such as Segmentino and BeatRoot. Once the melody, chord and beat placement of each segment has been extracted, the key, melody, chord progression and beat to use for the transitional audio signal can be determined, for example by determining which melody, chord progression and beat is most common to all of the melody, chord and beat extracted segments. Once this has been determined, the notes of the chords and melody are converted to MIDI notes as are the transcribed beats.

The MIDI notes for the melody, chords and the beats, along with information such as musical genre, musical key and any metadata related to the preceding or succeeding audio signal used by a music generation engine to create S76 the music for the transitional audio signal.

The music generation engine that is used to generate transitional audio signals takes a number of inputs, for example musical key, musical melody, beat structure and musical genre. It also takes as an input, the desired level of musical complexity, which determines how similar the generated music is to either the preceding or succeeding audio signal. The level of complexity may be obtained S75 from a user preference or may be predetermined. In an embodiment levels of complexity from 1 to 10 are used as described below. More, fewer and/or different approaches can also be employed.

Level 1: the key, chord and tempo information are used to play just the root chord of the preceding or succeeding audio signal using a sampled instrument, e.g. a piano. The beat structure and tempo of either the preceding or succeeding audio signal is then used to generate a similar beat using a sampler or synthesizer.

Level 2: Similar to level 1, but the sampled instrument, e.g. piano, is replaced with an instrument that is similar to the chord playing instrument in either the preceding or succeeding audio signal. The beat may remain the same as level 1, but the structure of how the root chord is being played is slightly varied.

Level 3: Similar to level 2, but now a synthesized or sampled bass instrument is added based on the transcribed melody.

Level 4: Similar to level 3, but the chord progression with the respect to the key of the song is randomized, without imitating the chord progression in the either the preceding or succeeding audio signal. A gap may now be added to the beat in order to indicate a section change (fill).

Level 5: Similar to level 4, but the beat is shuffled or a clap added on every second beat to give it some variation.

Level 6: Similar to level 5, but another instrument that has a similar timbre to some of the instrumentation in either the preceding or succeeding audio signal is added. The melody of the new instrument is similar to the melody of the main instrument in the preceding or succeeding audio signal.

Level 7: Similar to level 6, but the automatically generated chord progression is changed to be more similar to the chord progression in either the preceding or succeeding audio signal.

Level 8: Similar to level 7, but now the chord progression mimics exactly the chord progression in either the preceding or succeeding audio signal and/or the drum fill mimics that of either the preceding or succeeding audio signal.

Level 9: Similar to level 8, but the beat and instrumentation are both be identical to that of either the preceding or succeeding audio signal.

Level 10: at this level there is maximum complexity. The instrumentation, melody, chord progression and beat structure mimic the preceding or succeeding audio signal as close as possible.

Figure 8:
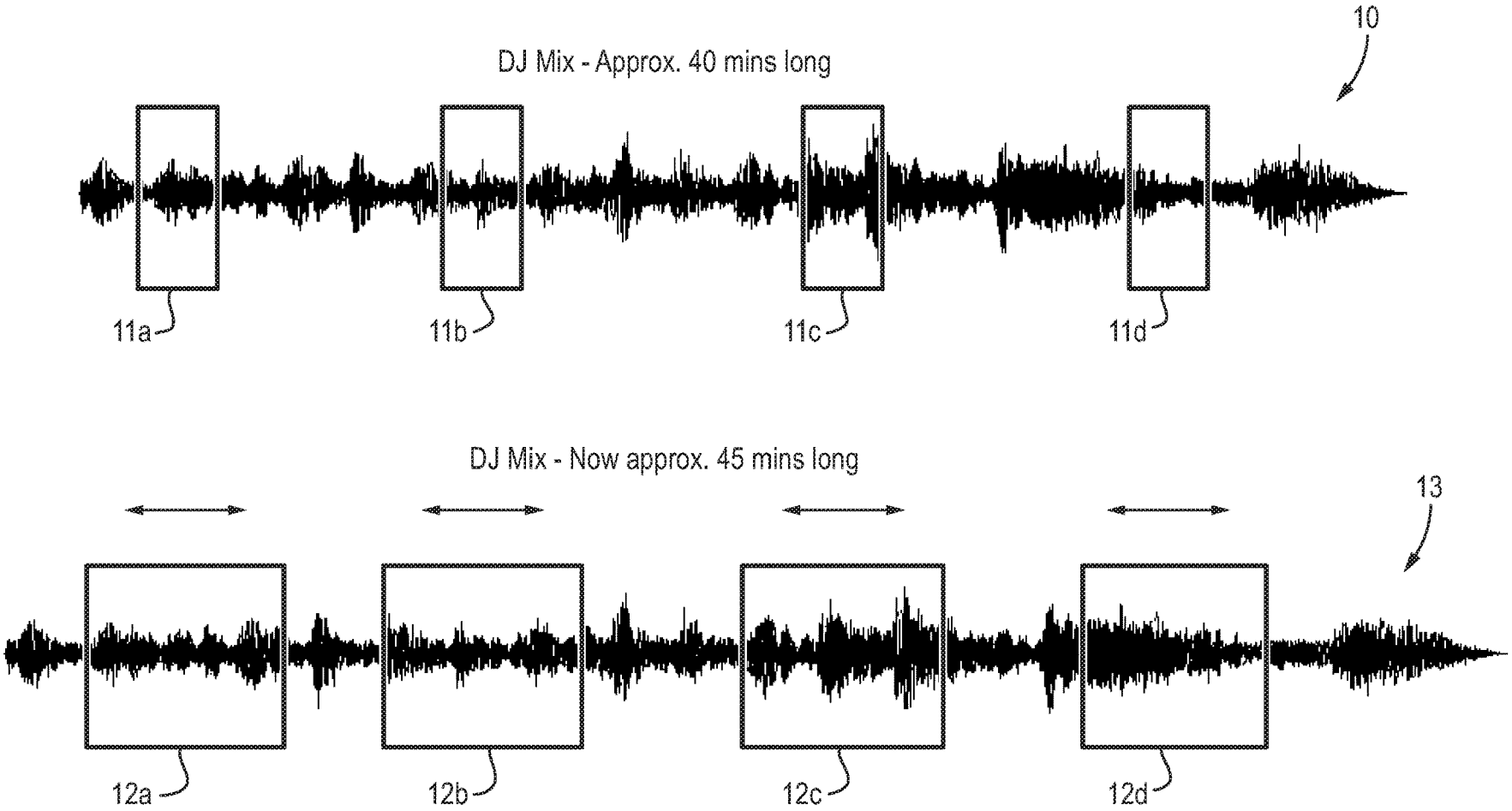
FIG. 8 depicts transitional sections in an extended audio signal.

A further embodiment of the invention is configured to insert a transitional audio signal into an audio signal, e.g. one that is of a considerable length such as a DJ mix 10, as shown in FIG. 8. It is difficult to insert a transitional section into an already recorded DJ mix without disrupting the flow of the music and annoying the listener. However, by finding musical sections 11*a*-11*d* that have no vocals, it is possible to either loop the desired sections or else replicate them to a desired complexity (as described above) and then mix the resulting supplemental sections 12*a*-12*d* it into the DJ mix 10 to form a combined audio signal 13. The supplemental audio signal may include any of the message types indicated above or a message related to the DJ or the song that is currently being played.

Figure 9:
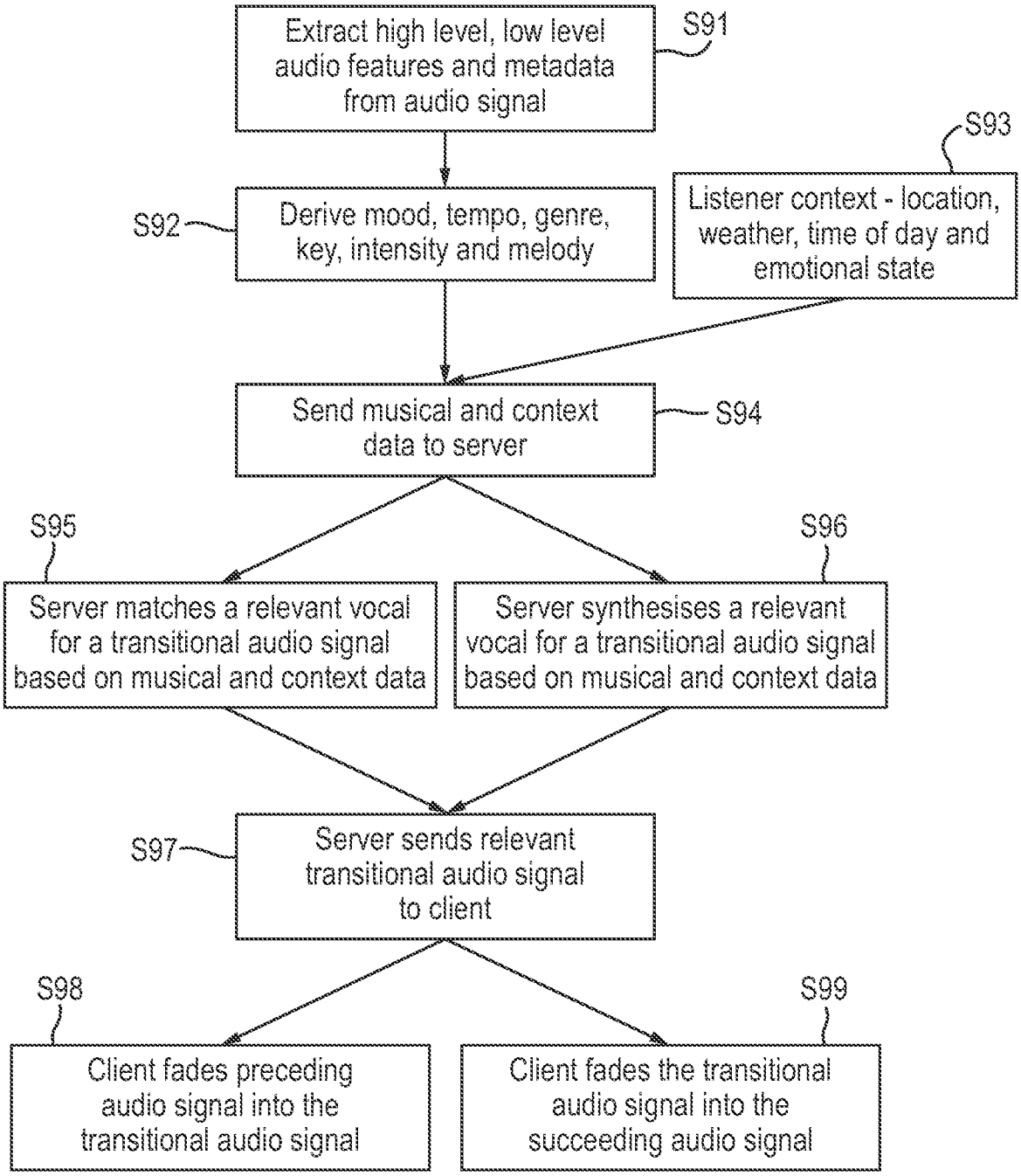
FIG. 9 is a flow diagram of a method of the invention showing how the apparatus generates the vocals for a transitional audio signal.

FIG. 9 illustrates an embodiment of the invention in which the transitional audio signal includes a vocal element, which can either be pre-recorded or synthesized. The vocal element can be used alone or combined with a musical element obtained by any of the above described methods. In FIG. 9, steps S91 to S94 and S97 to S99 are the same as the corresponding steps in the above described embodiments. The type of message to be played can be configured by the user of the apparatus or it can be automatically selected based on the context of the listener. In the first instance where the vocals are pre-recorded, the vocals are selected from a database S95. The database contains pre-recorded messages and the vocal message can be matched based on the musical mood, musical intensity, musical genre, musical key, musical melody, musical tempo, musical metadata and/or sentiment of the lyrics of either the preceding audio signal and/or the succeeding audio signal. There may be a dependency on the type of background music if it has already been selected. In this particular instance, as mentioned previously, the context of the listener may also determine what pre-recorded vocal is selected, e.g. a change in weather selects a weather report or an alert message. Multiple pre-recorded messages can be combined to form the vocal element. Alternatively or in addition, a pre-recorded message may be reduced in length by cutting part of it.

In the second instance where the vocal is to be synthesized, a message such as a news report or information about the background music will be fed to a text to speech algorithm (TTS) in order to vocalize the message S96. Various TTS algorithms are known and are available as on-line services. An approach that is particularly suitable is a network that maps character embeddings to mel-scale spectrograms, followed by a modified WaveNet model acting as a vocoder to synthesize time-domain waveforms from those spectrograms as described in [Ref. 11].

The synthesized vocal in the transitional audio signal may also be configured to imitate the vocalist in either the preceding audio signal or the succeeding audio signal by using a model that is based on features produced by a parametric vocoder that separates the influence of pitch and timbre as described in [Ref 12]. Alternatively, the style and tone of voice can be configured by the user of the apparatus or else determined using a style library, where the style library configures the voice based on such inputs as musical genre, etc. The speed of delivery of the synthesized vocal can be controlled, for example to fit the message to a desired duration.

Figure 10:
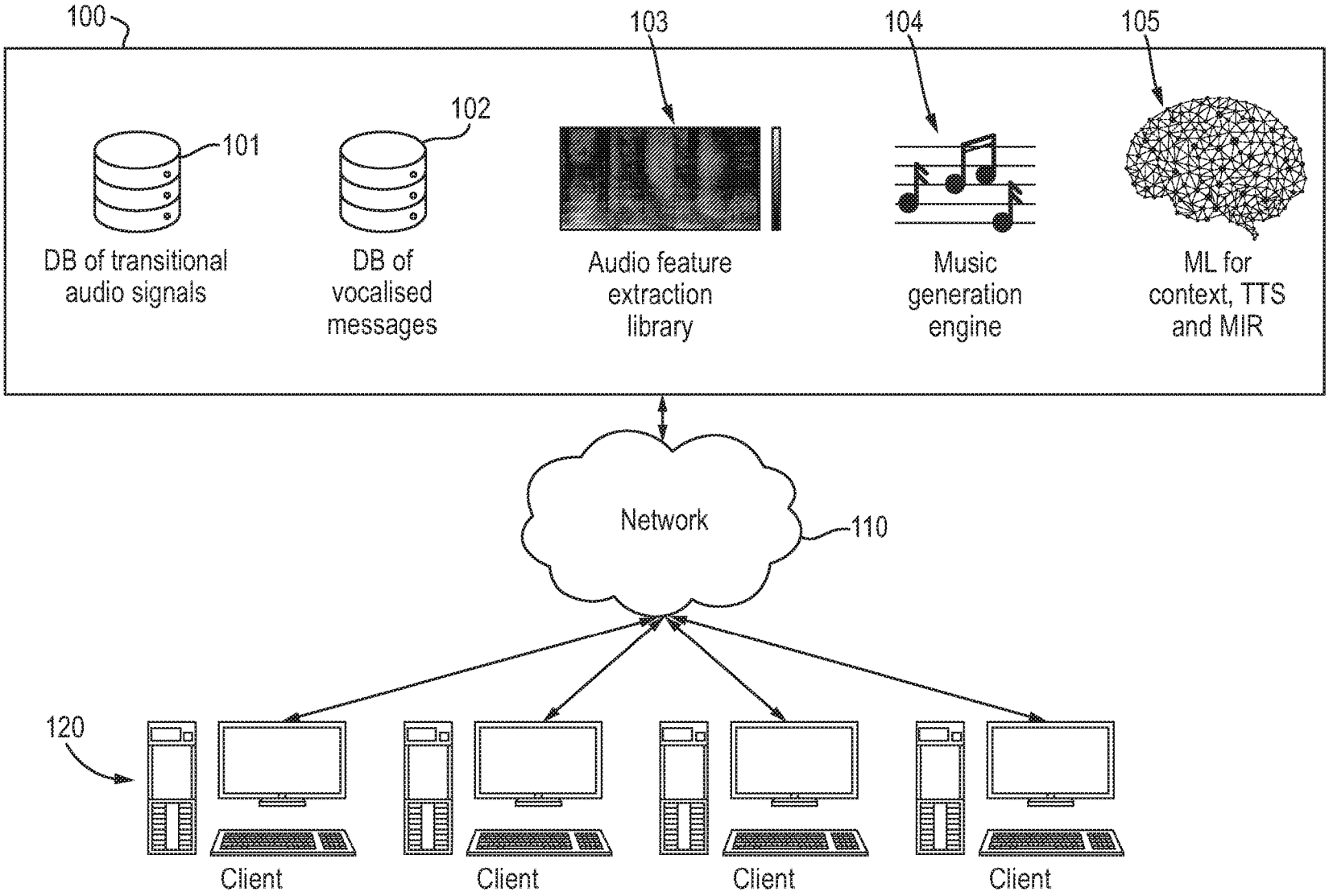
FIG. 10 is a schematic diagram of a computer system embodying the invention.

FIG. 10 is a schematic diagram of a system that can implement the invention. The audio transition generation server 100 interacts with a plurality of clients 120 over a computer network 110 such as the internet. The audio transition generation server 100 includes a music database 101 of transitional audio signals consisting of music and a vocal database 102 of transitional audio signals consisting of vocals. The music database 101 and vocal database 102 can be implemented in any convenient database type, such as SQL or NoSQL, and can be combined if desired. There is also an audio feature extraction library 103 used for determining musical mood, musical intensity, musical genre, musical key, musical melody, musical tempo. There is a music generation engine 104 for creating music to a desired complexity. There is also a machine learning engine 105 for determining the context of the listener, generating TTS and performing MIR classification tasks. Machine learning engine 105 may comprise several different ML algorithms that have been separately trained to accomplish respective tasks.

Figure 11:
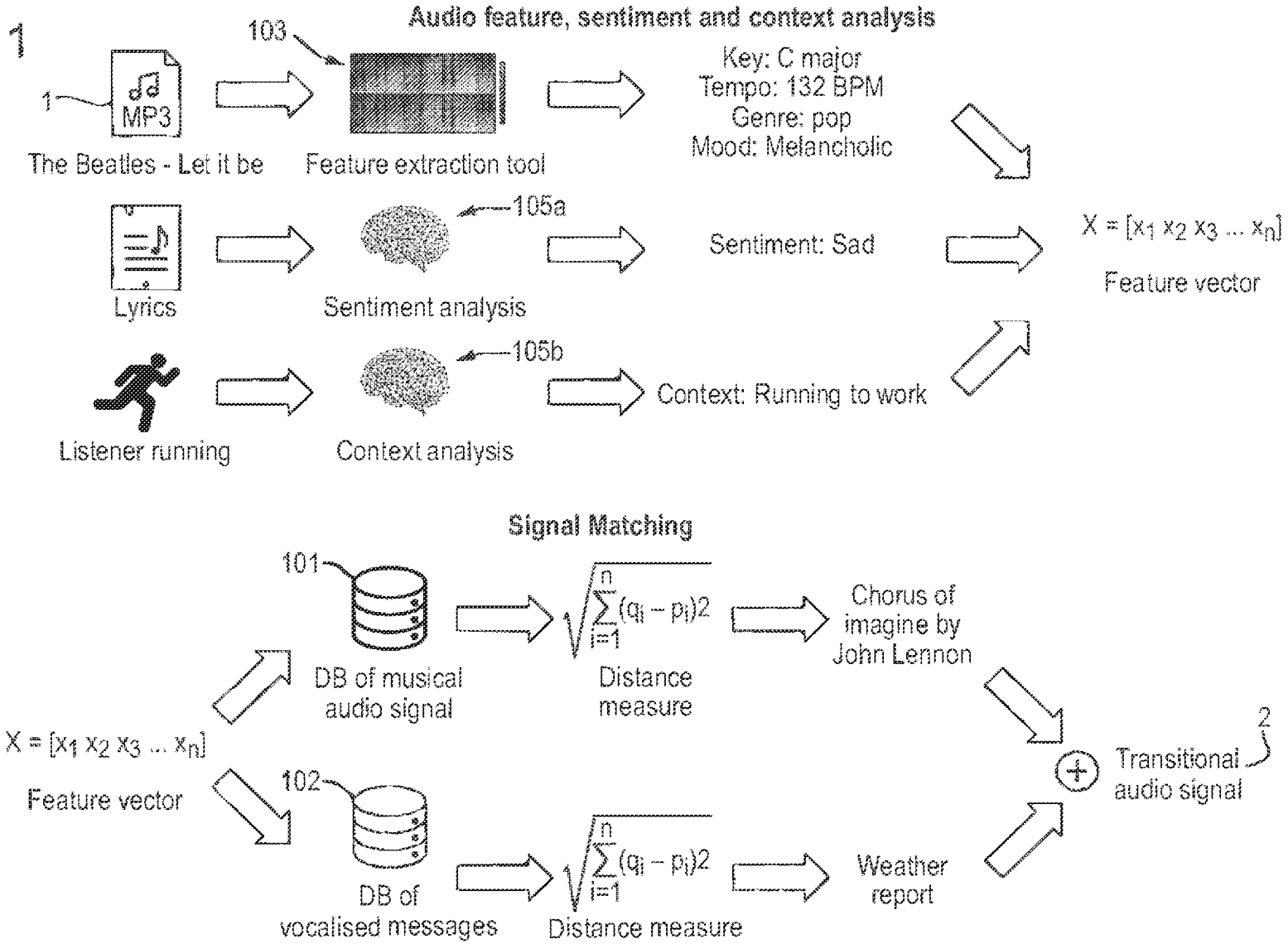
FIG. 11 depicts a worked example involving simple matching of a preceding audio signal to a transitional audio signal in a database.
Figure 12:
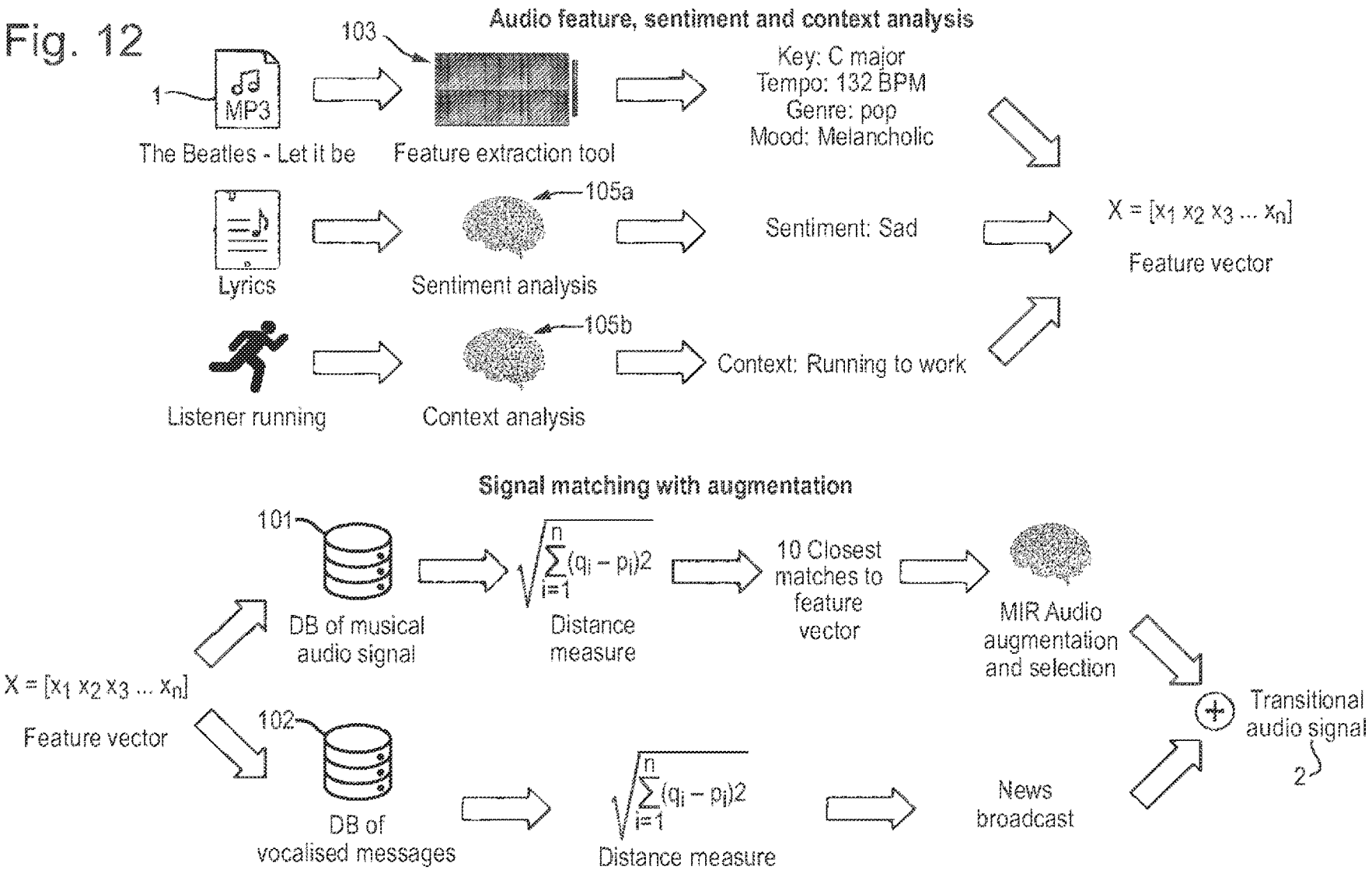
FIG. 12 depicts a worked example involving matching of a preceding audio signal to a number of audio signals in a database where augmentation occurs in order to find the most suitable transitional audio section.
Figure 13:
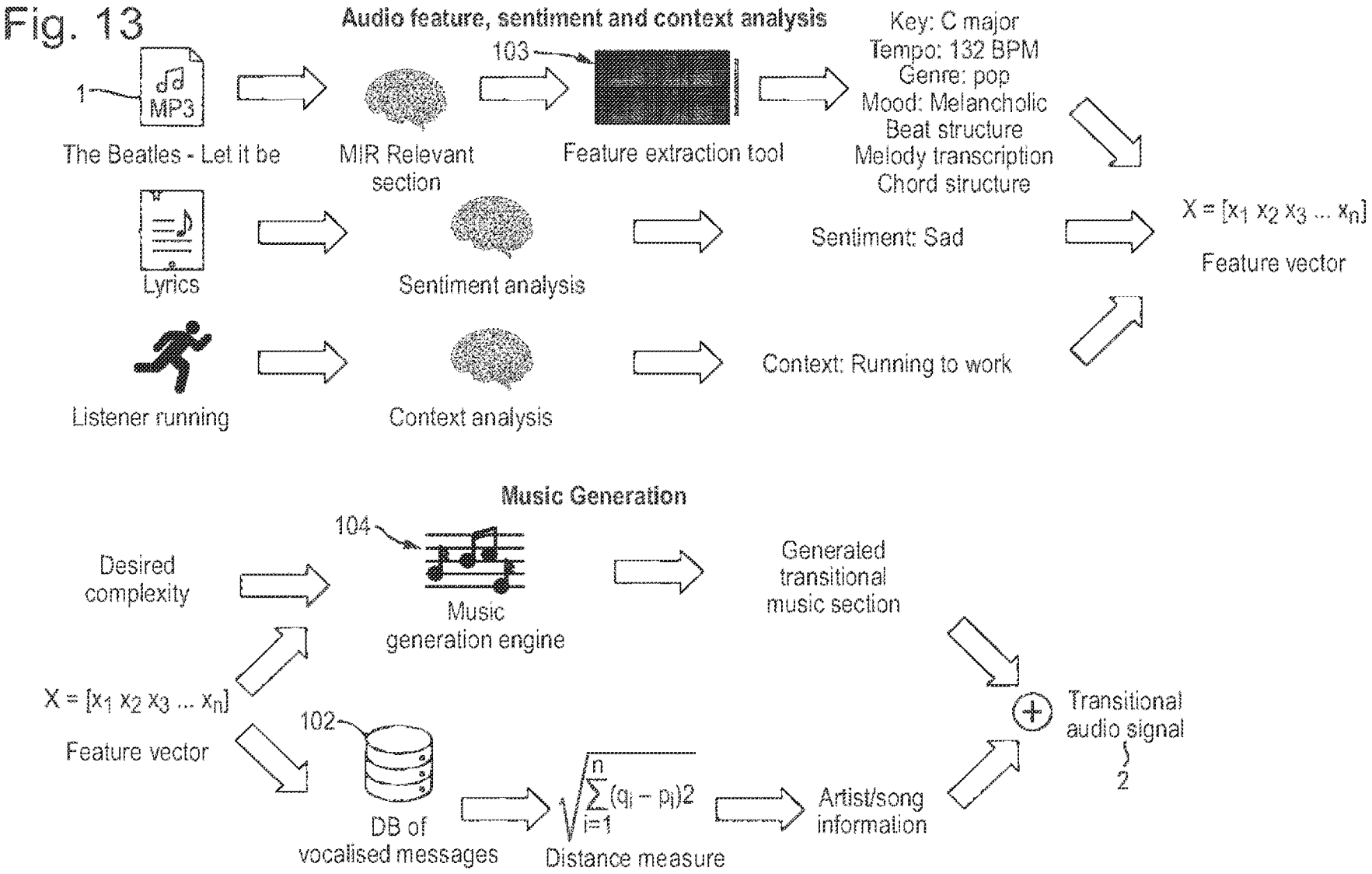
FIG. 13 depicts a worked example involving generating a transitional audio signal based on features extracted from the preceding audio signal.

FIGS. 10, 11 and 12 depict worked examples of how a transitional audio signal is generated for a particular song. "The Beatles—Let It Be" is used as an example song and the method of the invention generates a transitional section to occur after "Let It Be". FIG. 11 illustrates a simple transitional audio signal matching by selecting musical and vocal elements from respective databases 101, 102. FIG. 12 illustrates augmented audio signal matching, in which multiple selected musical elements are modified before a further selection of one element to use is made. FIG. 13 illustrates automatic generation of a musical element for the transitional audio signals. In the latter example, more characteristics of the source audio signal are used than in the first two.

The invention has been described above in relation to specific embodiments however the reader will appreciate that the invention is not so limited and can be embodied in different ways. For example, the invention can be implemented on a general-purpose computer but can also be implemented in whole or part application specific integrated circuits. The invention can be implemented on a standalone computer, e.g. a personal computer or workstation, a mobile phone or a tablet, or in a client-server environment as a hosted application. Multiple computers can be used to perform different steps of the method rather than all steps being carried out on a single computer. A computer program embodying the invention can be a standalone software program, an update or extension to an existing program, or a callable function in a function library. A computer program embodying the invention can be stored in a non-transitory computer readable storage medium such as an optical disk or magnetic disk or non-volatile memory.

Outputs of a method of the invention can be broadcast or streamed in any convenient format, played on any convenient audio device or stored in electronic form in any convenient file structure (e.g. mp3, WAV, an executable file, etc.). If the output of the invention is provided in the form of a stream or playlist, the transitional audio signal can be presented as a track of its own or combined into either of the preceding and succeeding tracks. The source audio signals and the transitional audio signals can be provided from separate sources (e.g. servers) and a remotely generated transitional audio signal can be combined with locally stored source audio streams. If the output of the invention is provided in the form of a stream or playlist, then if a user fast-forwards or skips, reproduction may advance to the start, end or an intermediate position of the transitional audio signal. In an embodiment, if the user fast-forwards or skips this is taken into account in generation of the transitional audio signal, for example by omitting information of the preceding track and providing only an introduction of the succeeding track. Other actions performed by the user in relation to the playback device can also be taken into account.

The invention should not be limited except by the appended claims.

REFERENCES

The following documents are hereby incorporated by reference in their entirety.

[Ref. 1] Kim, Youngmoo E., et al. "Music emotion recognition: A state of the art review." Proc. ISMIR. 2010.

[Ref. 2] Wang, Zhe, Jingbo Xia, and Bin Luo. "The Analysis and Comparison of Vital Acoustic Features in Content-Based Classification of Music Genre." Information Technology and Applications (ITA), 2013 International Conference on. IEEE, 2013.

[Ref. 3] Moffat, David, David Ronan, and Joshua D. Reiss. "An evaluation of audio feature extraction toolboxes." International Conference on Digital Audio Effects (DAFx), 2016.

[Ref. 4] Jamdar, Adit, et al. "Emotion analysis of songs based on lyrical and audio features." arXiv preprint arXiv: 1506.05012(2015).

[Ref. 5] Mauch, Matthias, Katy C. Noland, and Simon Dixon. "Using Musical Structure to Enhance Automatic Chord Transcription." ISMIR. 2009.

[Ref. 6] Scholz, Florian, Igor Vatolkin, and Gunter Rudolph. "Singing Voice Detection across Different Music Genres." Audio Engineering Society Conference: 2017 AES International Conference on Semantic Audio. Audio Engineering Society, 2017.

[Ref. 7] Yela, Delia Fano, et al. "On the Importance of Temporal Context in Proximity Kernels: A Vocal Separation Case Study.", Audio Engineering Society Conference: 2017 AES International Conference on Semantic Audio.

[Ref. 8] R. ITU-R, "Itu-r bs. 1770-2, algorithms to measure audio programme loudness and true-peak audio level," International Telecommunications Union, Geneva, 2011

[Ref. 9] Salamon, Justin, et al. "Melody extraction from polyphonic music signals: Approaches, applications, and challenges." IEEE Signal Processing Magazine 31.2 (2014): 118-134.

[Ref. 10] Vogl, Richard, et al. "Drum transcription via joint beat and drum modeling using convolutional recurrent neural networks." Proceedings of the 18th International Society for Music Information Retrieval Conference (ISMIR), Suzhou, C N. 2018.

[Ref. 11] Shen, Jonathan, et al. "Natural TTS Synthesis by Conditioning WaveNet on Mel Spectrogram Predictions." arXiv preprint arXiv:1712.05884 (2017).

[Ref. 12] Blaauw, Merlijn, and Jordi Bonada. "A Neural Parametric Singing Synthesizer Modeling Timbre and Expression from Natural Songs." Applied Sciences 7.12 (2017): 1313.

[Ref. 13] McVicar, Matt, Daniel P W Ellis, and Masataka Goto. "Leveraging repetition for improved automatic lyric transcription in popular music." Acoustics, Speech and Signal Processing (ICASSP), 2014 IEEE International Conference on. IEEE, 2014.

The invention claimed is:

1. A method for automatically generating an audio signal, the method comprising:

receiving a source audio signal;

analyzing the source audio signal to identify one or more musical characteristics thereof, wherein identifying the one or more musical characteristics of the source audio signal comprises: extracting a feature vector for the source audio signal; and performing a sentiment analysis on the source audio signal;

performing a contextual analysis on a listener of the source audio signal;

obtaining a supplemental audio signal based on the one or more identified musical characteristics and the contextual analysis;

and combining the source audio signal and the supplemental audio signal to generate an extended audio signal, wherein obtaining the supplemental audio signal comprises:

receiving a transitional audio signal generated on a server based on the one or more identified musical characteristics and the contextual analysis.

2. The method according to claim 1, wherein obtaining a supplemental audio signal comprises: obtaining a musical element; obtaining a vocal element; and combining the musical and vocal elements.

3. The method according to claim 1, wherein obtaining a supplemental audio signal comprises: selecting a musical element from a database of pre-recorded musical elements on the basis of the one or more identified musical characteristics.

4. The method according to claim 1, wherein obtaining a supplemental audio signal comprises: selecting one or more musical elements from a database of pre-recorded musical elements on the basis of the one or more identified musical characteristics, modifying the selected plurality of musical elements to form a plurality of modified musical elements and selecting one of the modified musical elements as the supplemental audio signal.

5. The method according to claim 1, wherein obtaining a supplemental audio signal comprises: generating a musical element using a synthesizer based on the one or more identified musical characteristics.

6. The method according to claim 5, wherein generating the musical element comprises at least one of: playing a root chord of the source audio signal using a sampled instrument; generating a beat using a sampler or synthesizer based on a rhythm of the source audio signal; adding a synthesized or sampled bass instrument to a transcribed melody; generating a varying chord progression; and generating a varying rhythmic element.

7. The method according to claim 6, wherein the sampled instrument is a predetermined instrument or an instrumented selected to be similar to an instrument of the source audio signal.

8. The method according to claim 1, wherein obtaining a supplemental audio signal comprises: selecting a section of the source audio signal that has no vocal element.

9. The method according to claim 1, wherein the source audio signal comprises: a preceding audio signal and a succeeding audio signal, and wherein combining comprises: inserting the supplemental audio signal between the preceding audio signal and the succeeding audio signal.

10. The method according to claim 9, wherein analyzing comprises:

analyzing both the preceding audio signal and the succeeding audio signal to obtain respective musical characteristics, and wherein the obtaining is based on the musical characteristics obtained from each of the preceding audio signal and the succeeding audio signal.

11. The method according to claim 10, wherein the obtained supplemental audio signal is a transitional audio signal that has a musical characteristic that transitions between the musical parameters obtained from each of the preceding audio signal and the succeeding audio signal.

12. The method according to 1, wherein combining comprises: dividing the source audio signal into two sections and inserting the supplemental audio signal between the two sections.

13. The method according to claim 1, wherein obtaining the supplemental audio signal comprises: using a text-to-speech synthesizer to generate a vocal element from a text element.

14. The method according to claim 13, wherein the text element is a notification generated by an application or an operating system of a computing device.

15. The method according to claim 1, wherein the one or more identified musical characteristics are selected from the group consisting of: mood, intensity, genre, key, melody, tempo, metadata, and sentiment.

16. The method according to claim 1, wherein obtaining the supplemental audio signal is further dependent on context information relating to a user.

17. The method according to claim 16, wherein the context information is selected from the group consisting of: the location of the user; an activity being performed by the user, weather in the vicinity of the user; an emotional state of the user; an entry in an electronic calendar related to the user; an action performed by the user on a playback device.

18. A non-transitory computer readable medium storing a program comprising code that, when executed by a computer system, instructs the computer system to perform a method according to claim 1.

19. A computer system comprising: one or more processors and memory, wherein the memory stores a program that, when executed by the computer system, instructs the computer system to perform a method according to claim 1.

20. A client device comprising: a processor, a communication interface and memory, the memory storing a program comprising code for: storing user preferences; communicating context information to a server; receiving an audio signal generated according to claim 1 from the server; and playing the audio signal.

* * * * *